US007322762B2

(12) United States Patent
Murata et al.

(10) Patent No.: US 7,322,762 B2
(45) Date of Patent: Jan. 29, 2008

(54) TAPE-LIKE OBJECT FEEDING DEVICE AND LABEL TAPE PRINTING DEVICE

(75) Inventors: Susumu Murata, Nagoya (JP); Kazuyoshi Minaminaka, Suzuka (JP); Shigeki Kato, Toyoake (JP); Toshihiro Takahashi, Nagoya (JP); Shin Manabe, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/528,991

(22) PCT Filed: Sep. 18, 2003

(86) PCT No.: PCT/JP03/11947

§ 371 (c)(1),
(2), (4) Date: Mar. 24, 2005

(87) PCT Pub. No.: WO2004/028941

PCT Pub. Date: Apr. 8, 2004

(65) Prior Publication Data

US 2006/0039738 A1 Feb. 23, 2006

(30) Foreign Application Priority Data

Sep. 24, 2002 (JP) ..... 2002-276796

(51) Int. Cl.
*B41J 11/00* (2006.01)

(52) U.S. Cl. ..... 400/615; 400/611; 400/613; 400/621; 101/93.07

(58) Field of Classification Search ..... 400/621, 400/613, 613.1, 615.2, 615; 101/93.07
See application file for complete search history.

(56) References Cited

U.S. PATENT DOCUMENTS 5,061,697 A * 10/1991 Shasha et al. ..... 424/93.461
5,223,940 A * 6/1993 Matsumoto ..... 358/304
5,374,132 A * 12/1994 Kimura ..... 400/586
5,452,959 A * 9/1995 Oka ..... 400/149
5,503,485 A * 4/1996 Nakazato ..... 400/613
5,556,213 A * 9/1996 Kudo et al. ..... 400/621
5,709,486 A * 1/1998 Day ..... 400/208

(Continued)

FOREIGN PATENT DOCUMENTS

JP 06-340135 A 12/1994

(Continued)

*Primary Examiner*—Ren Yan
*Assistant Examiner*—Matthew Marini
(74) *Attorney, Agent, or Firm*—Oliff & Berridge, PLC

(57) ABSTRACT

A tape-like object feeding device in accordance with the present invention comprises a feeding mechanism 7 for feeding a tape-like object toward an outlet and a cutting mechanism 8 for cutting the tape-like object fed by the feeding mechanism. An ejection roller 62 is placed at a position on the outlet 9 side of the cutting mechanism 8. The ejection roller 62 ejects the tape-like object cut off by the cutting mechanism 8 through the outlet by revolving while making contact with the tape-like object. The feeding device further comprises control means which controls at least one of revolving speed, revolving time and revolving timing of the ejection roller 62 in the ejection of the tape-like object depending on at least one selected from the type of the tape-like object, the thickness of the tape-like object, the width of the tape-like object and a feeding length of the tape-like object by the feeding mechanism 7.

17 Claims, 16 Drawing Sheets

U.S. PATENT DOCUMENTS 5,730,536 A * 3/1998 Yamaguchi ..... 400/615.2
5,743,663 A * 4/1998 Imai ..... 400/120.04
5,768,675 A * 6/1998 Estabrooks ..... 399/385
5,769,411 A * 6/1998 Nakagawa et al. ..... 271/122
5,855,441 A * 1/1999 Kano ..... 400/615.2
6,012,860 A * 1/2000 Nunokawa et al. ..... 400/3
6,190,069 B1 * 2/2001 Yamaguchi et al. ..... 400/615.2
6,196,740 B1 * 3/2001 Yamaguchi et al. ..... 400/615.2
6,364,552 B1 * 4/2002 Nehowig et al. ..... 400/613
6,367,995 B1 * 4/2002 Hashimoto et al. ..... 400/207
6,408,750 B1 * 6/2002 Goto et al. ..... 101/226
6,447,186 B1 * 9/2002 Oguchi et al. ..... 400/621
6,485,206 B1 * 11/2002 Takahashi ..... 400/207
6,491,454 B1 * 12/2002 Toyosawa et al. ..... 400/83
6,652,173 B1 * 11/2003 Martini et al. ..... 400/621
2002/0021626 A1 * 2/2002 Yamamoto et al. ..... 400/120.1
2002/0094222 A1 * 7/2002 Furuya et al. ..... 400/615.2
2005/0031397 A1 * 2/2005 Miki et al. ..... 400/613
2006/0039738 A1 * 2/2006 Murata et al. ..... 400/615.2

FOREIGN PATENT DOCUMENTS

JP 07-214836 A 8/1995
JP 2002-167092 A 6/2002

* cited by examiner

DRIVING TIME OF EJECTION UNIT DRIVE MOTOR [ms]

104X

| | | LABEL TAPE STRIP LENGTH < 200 mm | | LABEL TAPE STRIP LENGTH ≧ 200 mm | |
|---|---|---|---|---|---|
| | | LAMINATE TYPE | NON-LAMINATE TYPE | LAMINATE TYPE | NON-LAMINATE TYPE |
| TAPE WIDTH | 6mm | 30 | 20 | 30 | 30 |
| | 9mm | 30 | 20 | 30 | 30 |
| | 12mm | 30 | 20 | 30 | 30 |
| | 18mm | 20 | 10 | 20 | 20 |
| | 24mm | 20 | 10 | 20 | 20 |
| | 36mm | 20 | 10 | 20 | 20 |

FIG. 16

TAPE-LIKE OBJECT FEEDING DEVICE AND LABEL TAPE PRINTING DEVICE

TECHNICAL FIELD

The present invention relates to the composition of a tape-like object feeding device capable of feeding a tape-like object, cutting the tape-like object being fed, and ejecting a tape strip which has been cut off.

BACKGROUND OF THE INVENTION

As a conventional tape-like object feeding device (device for feeding a tape-like object), a configuration for cutting tape with a cutting mechanism and thereafter forcefully ejecting the tape strip through an outlet is well known. For example, one of such configurations has been described in Japanese Patent Provisional Publication No. 2002-167092. In the configuration described in the document, an ejection roller is placed by a tape ejection path. The ejection roller makes contact with the tape strip while revolving and thereby flicks out the tape strip to the outside of the device. Between the ejection roller and a motor for driving the roller, a power transmission mechanism is installed.

DISCLOSURE OF THE INVENTION

However, conventional tape-like object feeding devices have not been able to change the ejecting power (revolving time, revolving speed, etc.) of the ejection roller properly even when the width, type, etc. of the tape to be ejected varies.

Therefore, when a lot of tape strips of various lengths are ejected from the outlet, the tape strips are scattered about randomly and the work of collecting the scattered tape strips later has been a burden on users.

It is therefore the primary object of the present invention to provide a feeding device capable of properly changing the ejecting power of the ejection roller when the width, type, etc. of the tape to be ejected varies.

In accordance with an aspect of the present invention, there is provided a tape-like object feeding device for feeding a tape-like object, comprising a feeding mechanism that feeds the tape-like object toward an outlet, a cutting mechanism that cuts the tape-like object fed by the feeding mechanism, an ejection roller placed on the outlet side of the cutting mechanism for ejecting the tape-like object cut off by the cutting mechanism through the outlet by revolving while making contact with the tape-like object, and control means which controls at least one of revolving speed, revolving time and revolving timing of the ejection roller in the ejection of the tape-like object depending on at least one selected from a type of the tape-like object, a thickness of the tape-like object, a width of the tape-like object and a feeding length of the tape-like object by the feeding mechanism.

By the above composition, ejection distance of the tape-like object by the ejection roller can be changed and adjusted depending on the thickness, width, type or feeding length of the tape-like object. Therefore, even when a lot of tape-like objects are cut off and ejected, the random scattering of the tape-like objects can be avoided and the tape-like objects can be handled in a lump.

In accordance with another aspect of the present invention, there is provided a tape-like object feeding device for feeding a tape-like object, comprising a feeding mechanism that feeds the tape-like object toward an outlet, a cutting mechanism that cuts the tape-like object fed by the feeding mechanism, an ejection roller placed on a downstream side of the cutting mechanism in a feeding path of the tape-like object for ejecting the tape-like object cut off by the cutting mechanism by revolving while making contact with the tape-like object, and control means which executes driving control of the ejection roller in the ejection of the tape-like object which has been cut off, depending on at least one selected from a type of the tape-like object and a feeding length of the tape-like object by the feeding mechanism at a point when the tape-like object is cut off by the cutting mechanism.

By this composition, the ejection distance of the tape-like object can be changed and adjusted depending on at least one of the type of the tape-like object and the feeding length of the tape-like object by the feeding mechanism at the point when the tape-like object is cut off by the cutting mechanism.

In accordance with another aspect of the present invention, there is provided a printing device comprising a feeding mechanism that feeds a tape-like object toward an outlet, a cutting mechanism that cuts the tape-like object fed by the feeding mechanism, an ejection roller placed on a downstream side of the cutting mechanism in a feeding path of the tape-like object for ejecting the tape-like object cut off by the cutting mechanism by revolving while making contact with the tape-like object, an image formation unit placed on an upstream side of the cutting mechanism in the feeding path for forming an image on the tape-like object, and control means which executes driving control of the ejection roller in the ejection of the tape-like object which has been cut off, depending on at least one selected from a type of the tape-like object and a feeding length of the tape-like object by the feeding mechanism at a point when the tape-like object is cut off by the cutting mechanism.

By this composition, the ejection distance of the tape-like object can be changed and adjusted depending on at least one of the type of the tape-like object and the feeding length of the tape-like object by the feeding mechanism at the point when the tape-like object is cut off by the cutting mechanism.

BRIEF DESCRIPTION OF THE DRAWINGS

FIG. 16 is a table showing a table stored in a ROM for specifying driving time of an ejection unit drive motor.

BEST MODE FOR CARRYING OUT THE INVENTION

Figure 1:
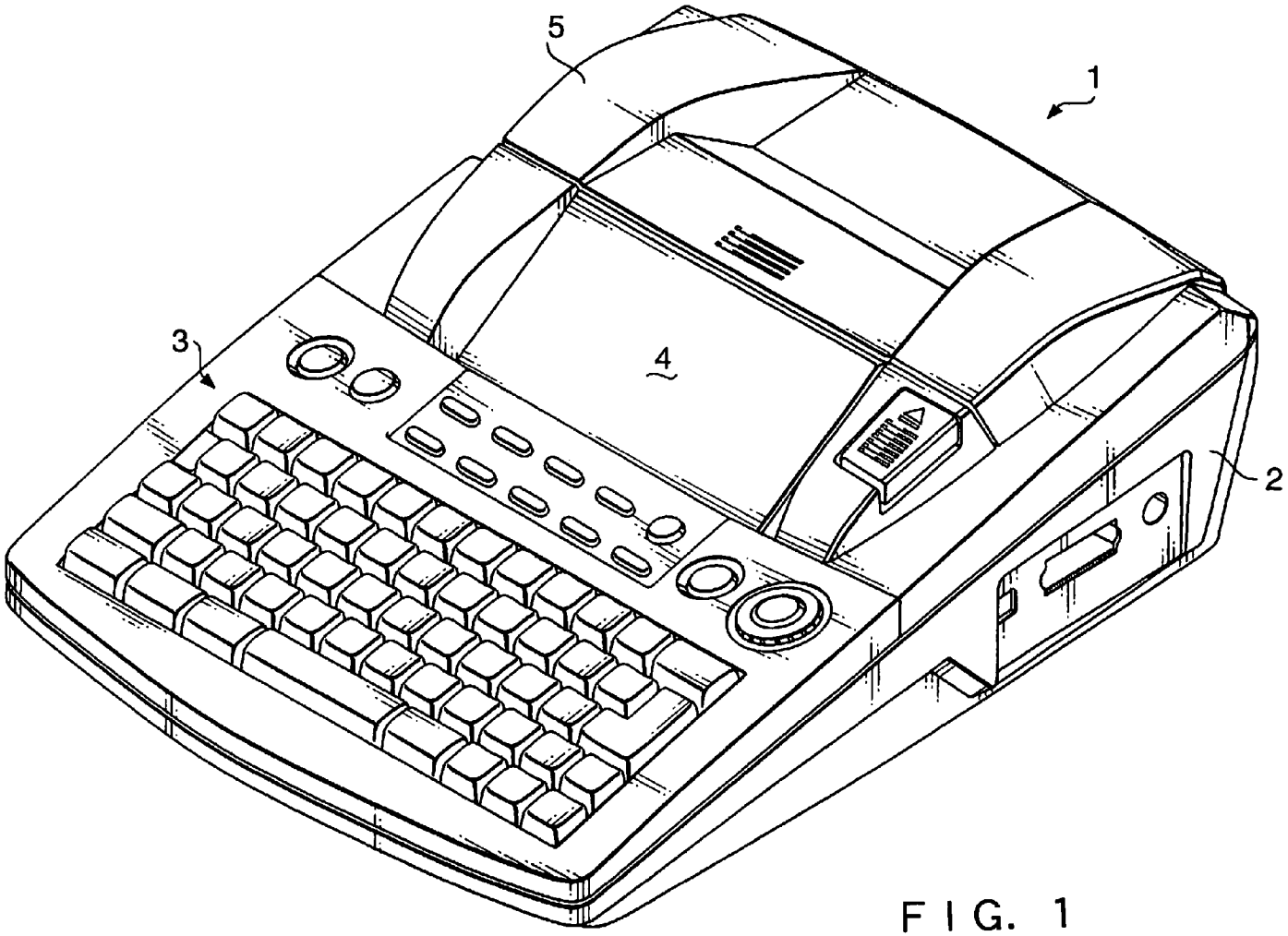
FIG. 1 is a perspective view showing the overall composition of a tape printing device in accordance with an embodiment of the present invention.

Referring now to the drawings, a description will be given in detail of a preferred embodiment in accordance with the present invention.

[Overall Composition]

First, the outline of a tape printing device in accordance with an embodiment of the present invention will be described below.

Figure 2:
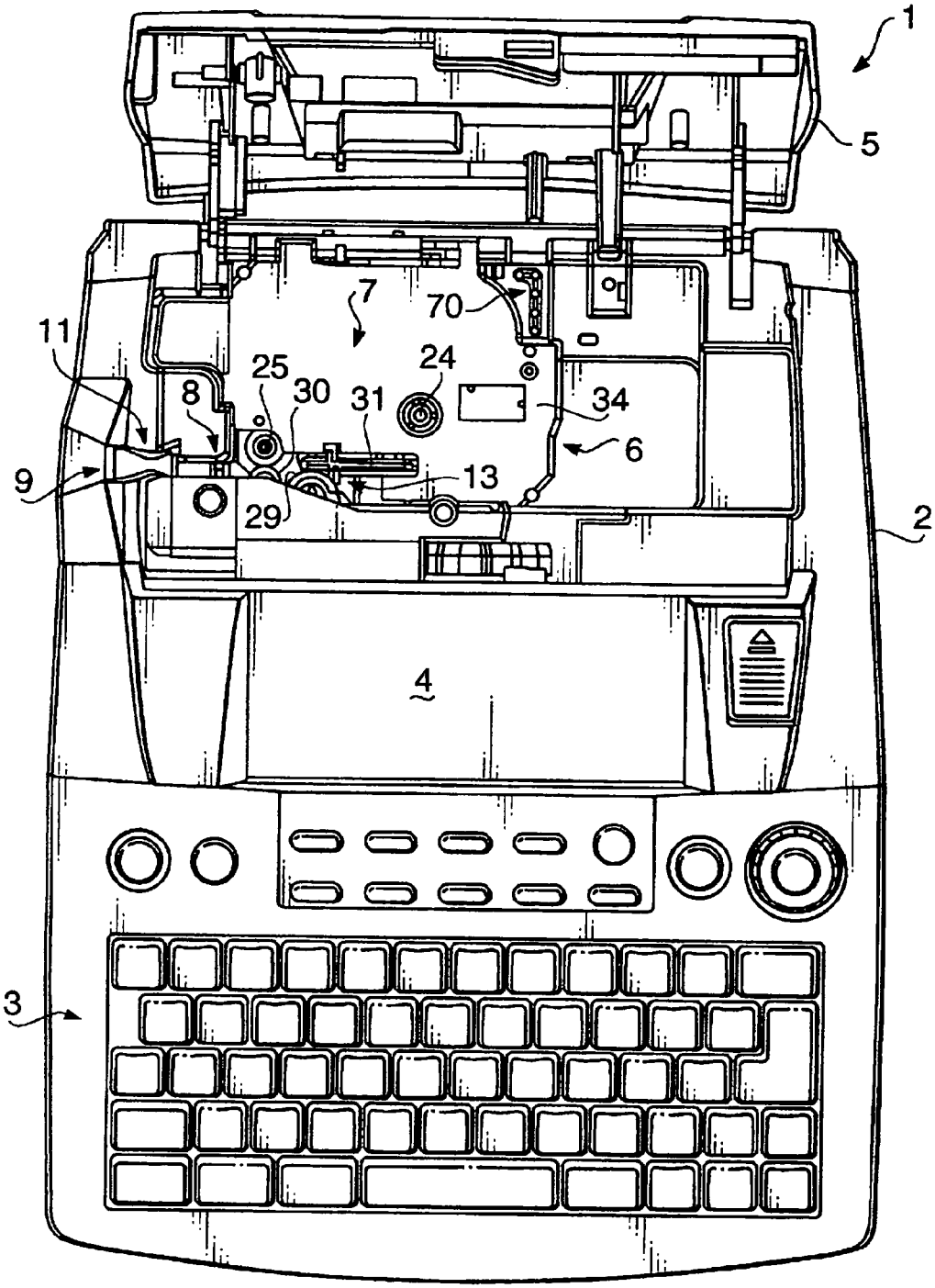
FIG. 2 is a plan view of the tape printing device with its lid opened.
Figure 3:
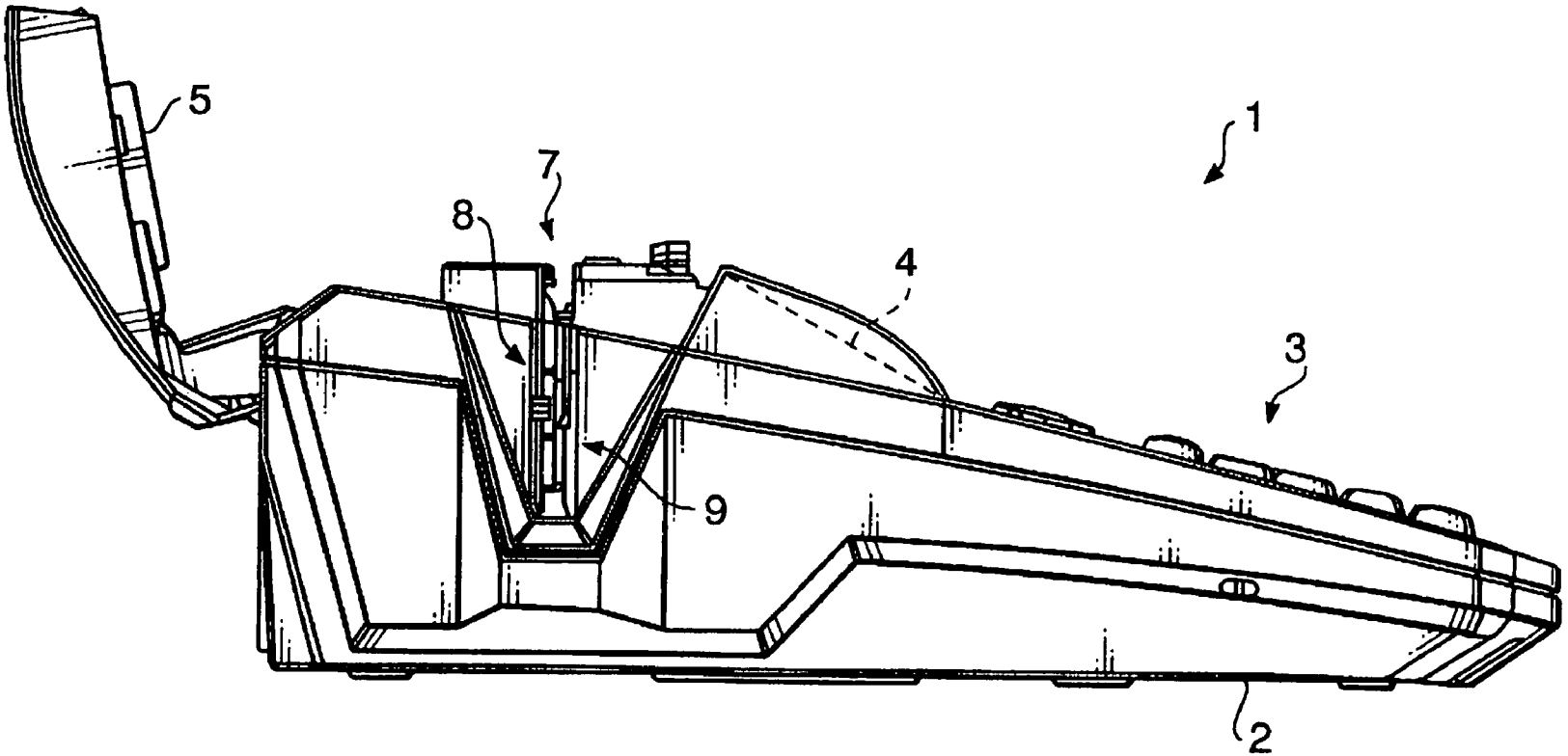
FIG. 3 is a side view of the tape printing device with its lid opened.

FIG. 1 is a perspective view showing the overall composition of the tape printing device in accordance with an embodiment of the present invention. FIG. 2 is a general plan view of the tape printing device with its lid opened. FIG. 3 is a general side view of the tape printing device with its lid opened.

The tape printing device 1 shown in FIG. 1 has a body 2 which contains an main control unit (not shown) including a CPU, RAM, etc. In a front part of the top of the body 2, various operation keys 3 such as a power key and character string input keys are arranged. The body 2 is provided with a liquid crystal display 4 for displaying inputted character strings, etc.

A lid 5 is rotatably provided to a rear part of the top of the body 2 to be openable and closable. FIGS. 2 and 3 shows a state in which the lid 5 has been opened. As shown in FIG. 2, a cartridge storing part 6, a tape feeding mechanism 7, a tape cutting mechanism 8 and a tape ejecting mechanism 11 are formed inside the lid 5.

Into the cartridge storing part 6 formed inside the lid 5, a tape cartridge 10 containing label tape can be loaded.

In this composition, when the tape cartridge 10 is loaded in the cartridge storing part 6 and a proper one (print key) of the operation keys 3 is pressed, the tape feeding mechanism 7 is driven and thereby the label tape is formed inside the tape cartridge 10 while a character string, etc. inputted through the keys 3 are printed on the label tape by a thermal head 32 (see FIG. 5) which will be explained later.

The label tape after being printed on is cut off by the tape cutting mechanism 8 when a proper one (cutting key) of the operation keys 3 is pressed, by which a strip of label tape is obtained. The label tape strip is ejected by the tape ejecting mechanism 11 through an outlet 9 (FIG. 2, FIG. 3) formed on a lateral face of the body 2.

[Composition Around Cartridge Storing Part]

Next, the composition around the cartridge storing part 6 will be described in detail referring to figures from FIG. 4.

Figure 4:
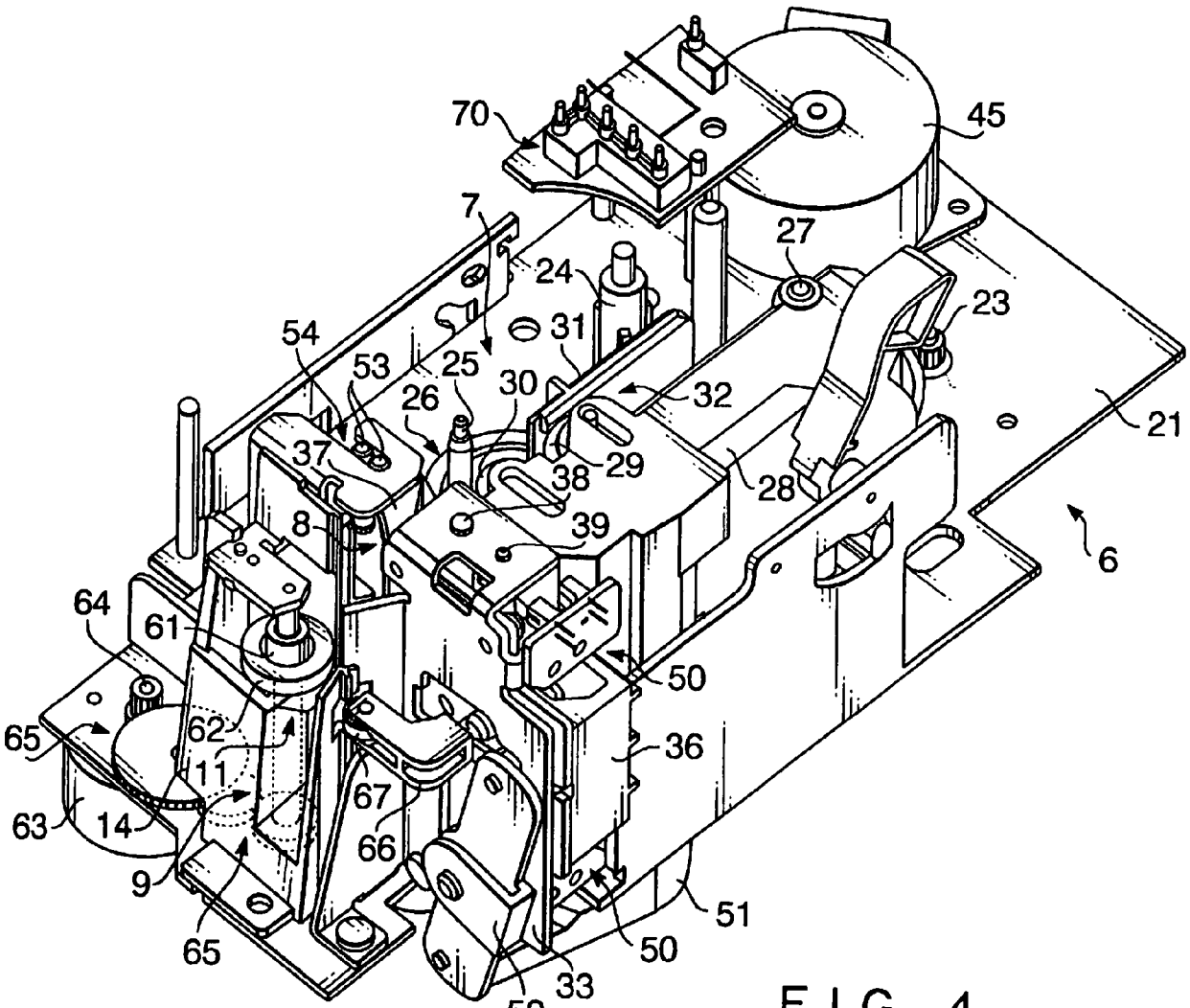
FIG. 4 is a perspective view showing the composition of a cartridge storing part.
Figure 5:
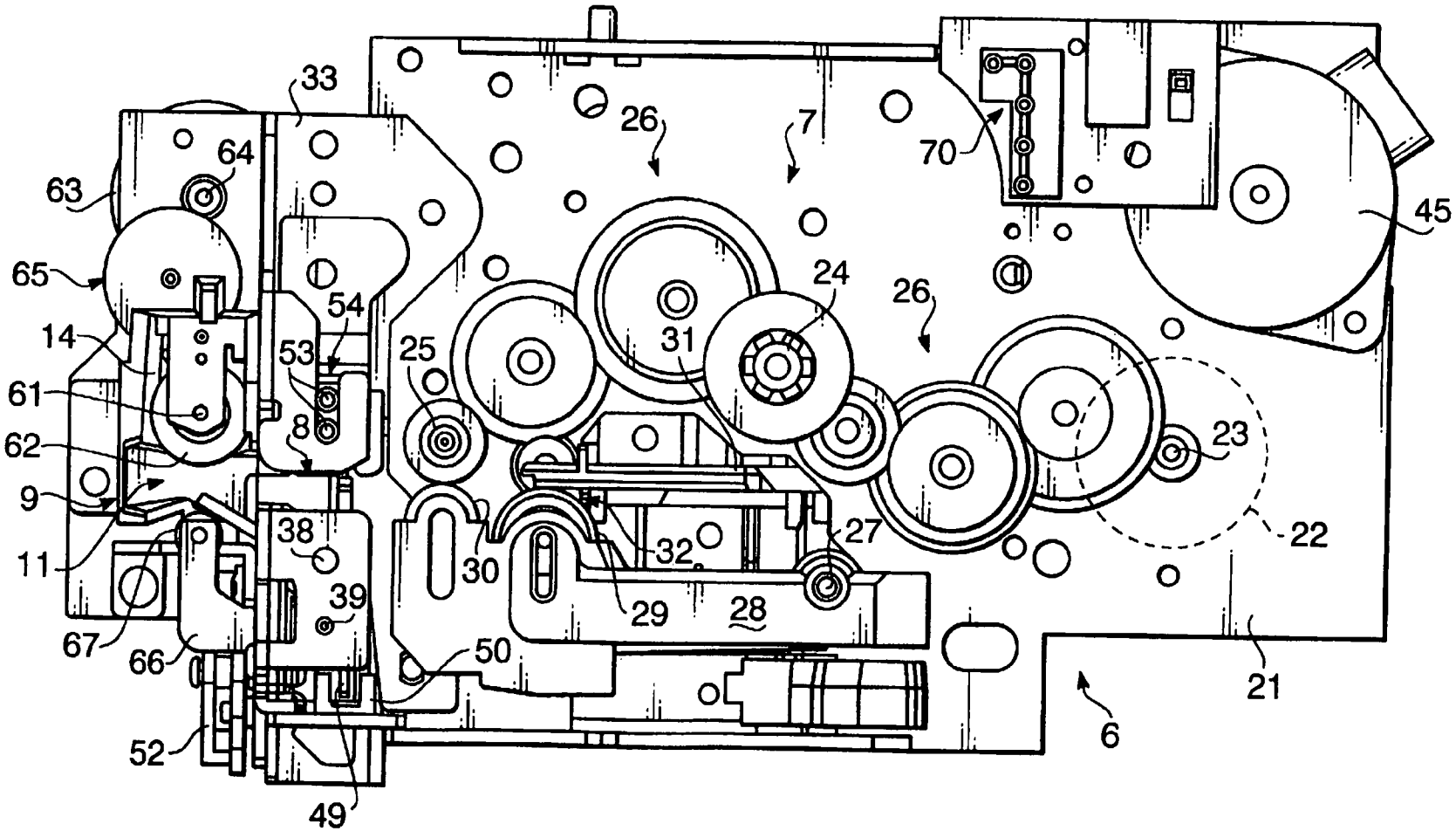
FIG. 5 is a plan view showing the composition of the cartridge storing part.
Figure 6:
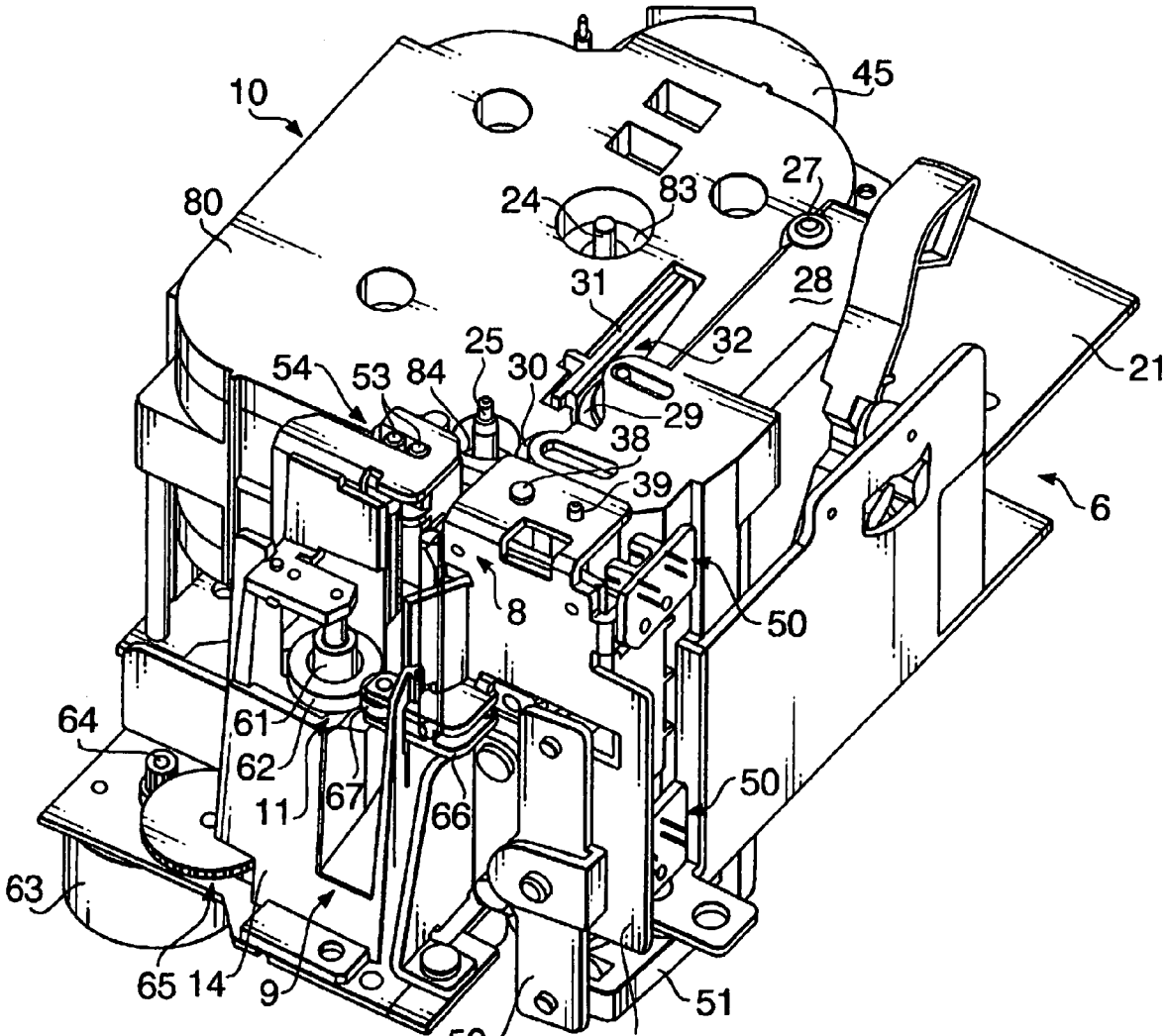
FIG. 6 is a perspective view showing a state in which a tape cartridge has been loaded in the cartridge storing part.
Figure 7:
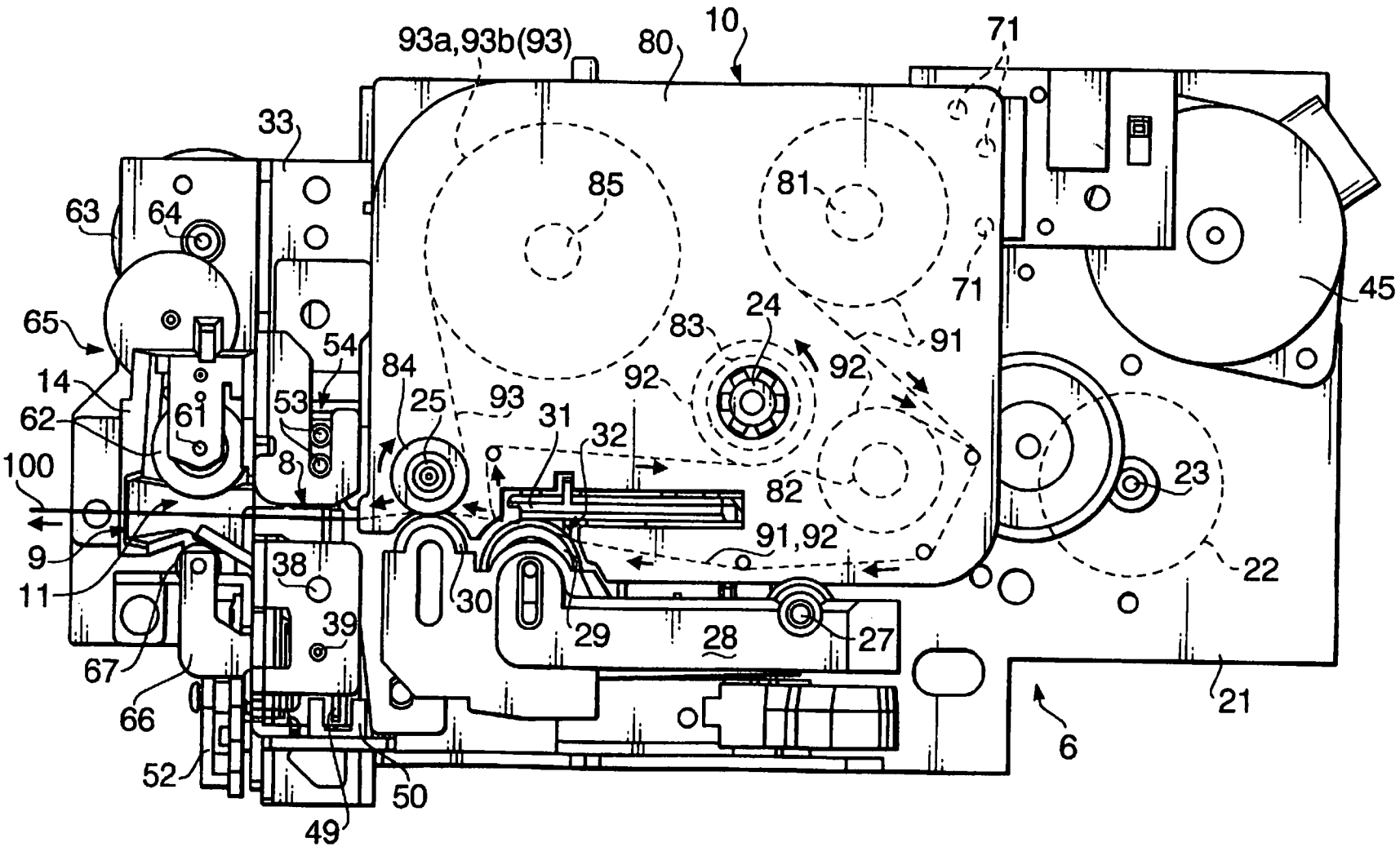
FIG. 7 is a plan view of the cartridge storing part showing the movement of tape being fed inside the tape cartridge.

FIG. 4 is a perspective view showing the composition of the cartridge storing part 6, FIG. 5 is a plan view showing the composition of the cartridge storing part 6, FIG. 6 is a perspective view showing a state in which a tape cartridge has been loaded in the cartridge storing part 6, and FIG. 7 is a plan view showing the movement of tape being fed inside the tape cartridge.

In FIGS. 4 and 5, the cartridge storing part 6, detached from the body 2 and loaded with no tape cartridge 10, is shown.

The cartridge storing part 6 includes a frame 21 which is made of a flat metal plate. On the under surface of the frame 21, a cartridge drive motor 22 is mounted (FIG. 5, etc.). The motor shaft 23 of the cartridge drive motor 22 projects into the top side of the frame 21. The motor shaft 23, a roll-up drive spindle 24 (rotatably supported by the frame 21) and a roller drive spindle 25 (rotatably supported by the frame 21) are linked together by a reduction gear train 26.

Although not shown in FIGS. 4 and 5, when the cartridge storing part 6 is attached to the body 2, a tabular cover plate 34 covering the reduction gear train 26 is attached as shown in FIG. 2, by which the reduction gear train 26 is protected from dust and dirt.

FIG. 6 shows a state in which the tape cartridge 10 has been loaded in the cartridge storing part 6. In the state of FIG. 6, the roll-up drive spindle 24 engages with a ribbon roll-up spool 83 (explained later) which is rotatably supported inside a housing 80 of the cartridge 10 while the roller drive spindle 25 engages with a joining roller 84 (explained later) which is rotatably supported similarly inside the cartridge 10.

Therefore, in this state, by driving the cartridge drive motor 22, the ribbon roll-up spool 83 and the joining roller 84 of the tape cartridge 10 can be driven. In other words, driving force by the cartridge drive motor 22 is utilized as driving force for feeding the tape inside the tape cartridge 10.

The frame 21 is provided with an arm 28 swingable around a spindle 27. Near the free end of the arm 28, a platen roller 29 and a feeding roller 30 (both having a surface made of elastic material such as rubber) are placed side by side to be rotatable.

The frame 21 is further provided with a plate 31 protruding therefrom. On the platen roller side of the plate 31, the thermal head 32 (as an image formation unit) is placed. The thermal head 32 has a plurality of heating elements arranged in one or more lines in a direction orthogonal to the feeding direction of the tape (specifically, laminate tape 91 which will be explained later).

The arm 28 is equipped with an bias spring (not shown). The bias spring constantly applies biasing force to the arm 28 for letting the platen roller 29 push the plate 31 and letting the feeding roller 30 push the joining roller 84 of the tape cartridge 10.

The tape printing device 1 of this embodiment can be used for printing on label tapes of various widths/types by replacing the tape cartridge 10.

For automatic detection of the type of the tape cartridge 10, a cartridge type sensor 70, including five push button switches (projecting vertically) arranged in the shape of "L", is provided to a proper position on the top surface of the frame 21 as shown in FIGS. 2 and 4. Meanwhile, on the tape cartridge 10, cartridge type indication holes 71 are formed at positions corresponding to some push button switches of the cartridge type sensor 70 (at parts of the base of the housing 80 in the vicinity of a corner) as shown in FIG. 7. The cartridge type indication holes 71 indicate the width, thickness, type (a laminate type, a non-laminate type (the so-called receptor type), an instant lettering type or a clothtransfer type (ironing transfer type)), etc. of the label tape of the tape cartridge 10 by their hole pattern (the presence/absence of a hole at each of five positions corresponding to the push button switches). Therefore, when the tape cartridge 10 is attached to the cartridge storing part 6, the tape printing device 1 can automatically judge the width, thickness, type, etc. of the label tape based on the result of detection by the cartridge type sensor 70.

Next, a tape cartridge capable of forming label tape of a laminate thermal transfer type will be explained below as a representative of the aforementioned various tape cartridges.

As shown in FIG. 7, the tape cartridge 10 of the laminate thermal transfer type includes a housing 80 which is made of synthetic resin in a box shape, a laminate spool 81, a ribbon supply spool 82, a ribbon roll-up spool 83, a joining roller 84 and a base supply spool 85. The laminate spool 81, ribbon supply spool 82, ribbon roll-up spool 83, joining roller 84 and base supply spool 85 are supported respectively inside the housing 80 to be rotatable.

Around the laminate spool 81, transparent laminate tape 91 made of a PET (polyethylene terephthalate) film, etc. is rolled up into a small roll. Around the ribbon supply spool 82, ink ribbon 92 is rolled up into a small roll.

Around the base supply spool 85, double-layer tape 93 is rolled up. The double-layer tape 93 is made of two layers: double-stick tape 93*a* (having an adhesive layer on both sides) and strippable tape 93*b* (stuck on one side of the double-stick tape 93*a*). The double-layer tape 93 has been rolled up around the base supply spool 85 with its strippable tape side facing outward and its opposite side (exposing the adhesive layer) facing inward.

As mentioned before, the joining roller 84 is rotatably supported inside the housing 80. The joining roller 84 pushes the feeding roller 30 of the main body and thereby joins the double-layer tape 93 supplied from the base supply spool 85 and the laminate tape 91 supplied from the laminate spool 81 together.

The ribbon roll-up spool 83 is also supported rotatably inside the housing 80. The ribbon roll-up spool 83 rolls up the ink ribbon 92 after being supplied from the ribbon supply spool 82 and used.

The ribbon roll-up spool 83 and the joining roller 84 are driven and rotated by power transferred from the cartridge drive motor 22 of the main body, by which the laminate tape 91 supplied from the laminate spool 81 and the ink ribbon 92 supplied from the ribbon supply spool 82 are overlaid on each other and fed to the thermal head 32. By selectively energizing heating elements of the thermal head 32 while the laminate tape 91 and the ink ribbon 92 stacked up are pressed against the thermal head 32 by the platen roller 29, ink on the ink ribbon 92 is transferred to the laminate tape 91. By this configuration, a desired image of a character string, symbols, etc. inputted through the keys 3 can be formed on the laminate tape 91.

After passing by the thermal head 32, the laminate tape 91 and the used ink ribbon 92 are fed separately. The laminate tape 91 is fed to the feeding roller 30. Meanwhile, as mentioned before, the double-layer tape 93 pulled out from the base supply spool 85 is fed to the joining roller 84 with its adhesive exposing side (with no strippable tape 93*b*) facing outward in regard to the joining roller 85. By the pressure of the feeding roller 30 and the joining roller 84, the laminate tape 91 and the double-layer tape 93 are joined and bonded together.

Consequently, label tape 100 having three-layer structure, including the double-layer tape 93 and the laminate tape 91 (on which characters, symbols, etc. have been recorded) stuck on the double-layer tape 93, is formed. The label tape 100 is fed toward the outlet 9 by the rotation of the joining roller 84. The label tape 100 which has been printed on and fed is cut off by the tape cutting mechanism 8 (provided in the vicinity of the outlet 9) and ejected by the tape ejecting mechanism 11 (also provided in the vicinity of the outlet 9). The detailed composition of the tape cutting mechanism 8 and the tape ejecting mechanism 11 will be described later.

From the label tape 100 ejected from the outlet 9, the strippable tape 93*b* can be stripped away to expose the adhesive layer. The label tape 100 exposing the adhesive layer can be used as a label which can be stuck on a desired part of a desired object.

[Composition of Tape Cutting Mechanism]

Next, the composition of the tape cutting mechanism 8 will be described.

Figure 8:
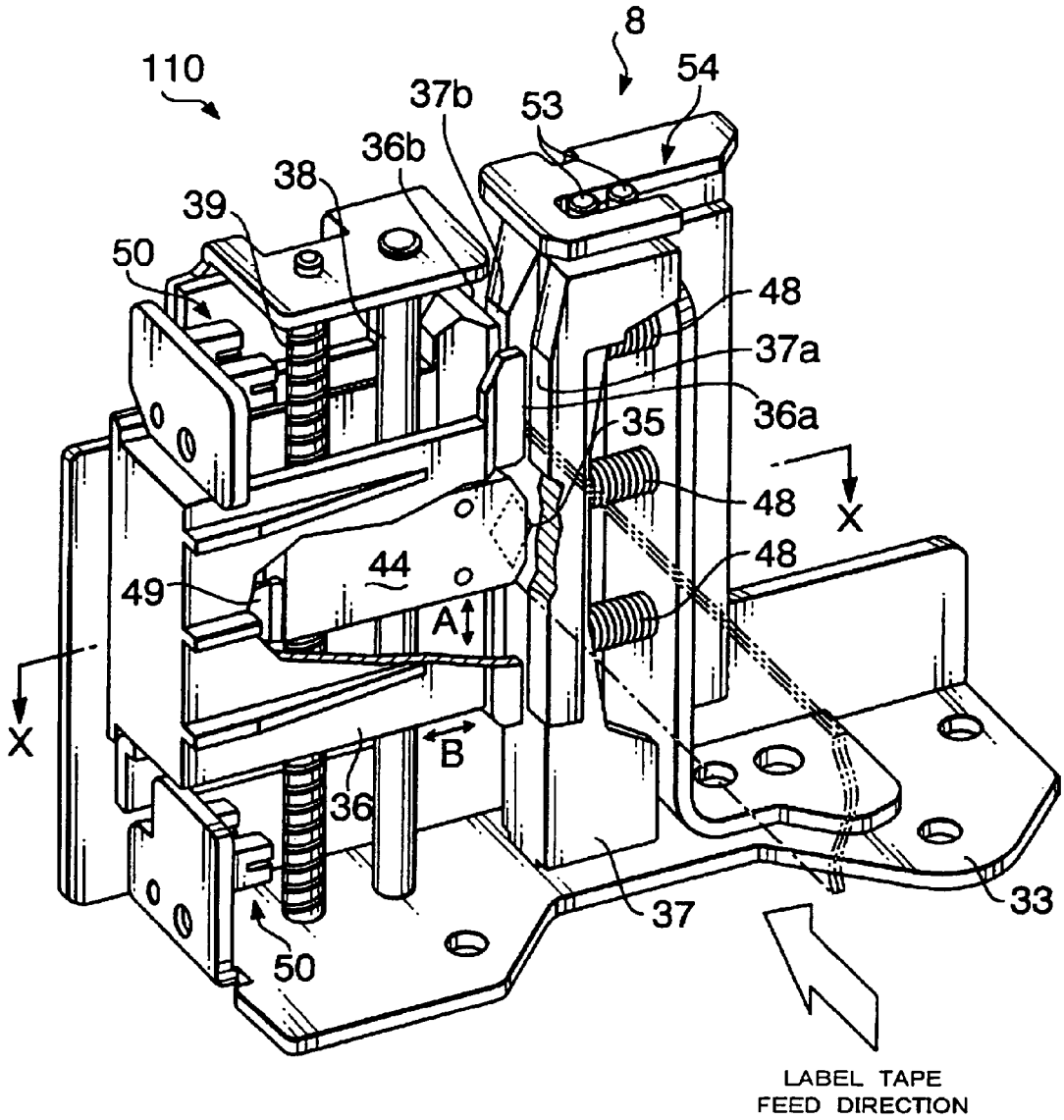
FIG. 8 is a perspective view showing the overall composition of a tape cutting mechanism.

FIG. 8 is a perspective view showing the overall composition of the tape cutting mechanism.

Incidentally, the thermal head 32 side (the upstream side in the tape feed direction) is in front of the sheet of FIG. 8 while the outlet 9 side (the downstream side) is behind the sheet of FIG. 8.

The tape cutting mechanism 8 has its own cutting mechanism frame 33. On the cutting mechanism frame 33, a plurality of members (including a cutter blade 35 for cutting the label tape 100, a retainer member 36 for holding the label tape 100 when the label tape 100 is cut by the cutter blade 35, a receiving member 37, etc.) are mounted integrally.

The cutting mechanism frame 33 can be fixed to the frame 21 of the cartridge storing part 6 with screws. Conversely, the cutting mechanism frame 33 can be detached from the frame 21 of the cartridge storing part 6 by taking out the screws while maintaining the state in which the members are integrally mounted on the cutting mechanism frame 33. Therefore, the cutting mechanism frame 33 allows for maintenance work (replacement of the cutter blade 35, etc.) in the state of FIG. 8 detached from the frame 21, by which easy maintenance is realized.

The composition of the tape cutting mechanism 8 will be explained in more detail referring to FIG. 8.

On one side of the traveling path of the label tape 100, a guide shaft 38 is vertically supported by the cutting mechanism frame 33 while a screw shaft 39 is rotatably supported in parallel with the guide shaft 38.

The guide shaft 38 supports a cutter carriage 44 so that the cutter carriage 44 can slide to and fro in the lengthwise direction of the guide shaft 38 (the direction indicated by an arrow A in FIG. 8, which is the width direction of the label tape 100). The cutter blade 35 is fixed to an edge of the cutter carriage 44 on the label tape 100 side. Into the cutter carriage 44, the screw shaft 39 is screwed, by which the cutter carriage 44 is moved to and fro in the direction of the arrow A when the screw shaft 39 is rotated normally and reversely.

Figure 9:
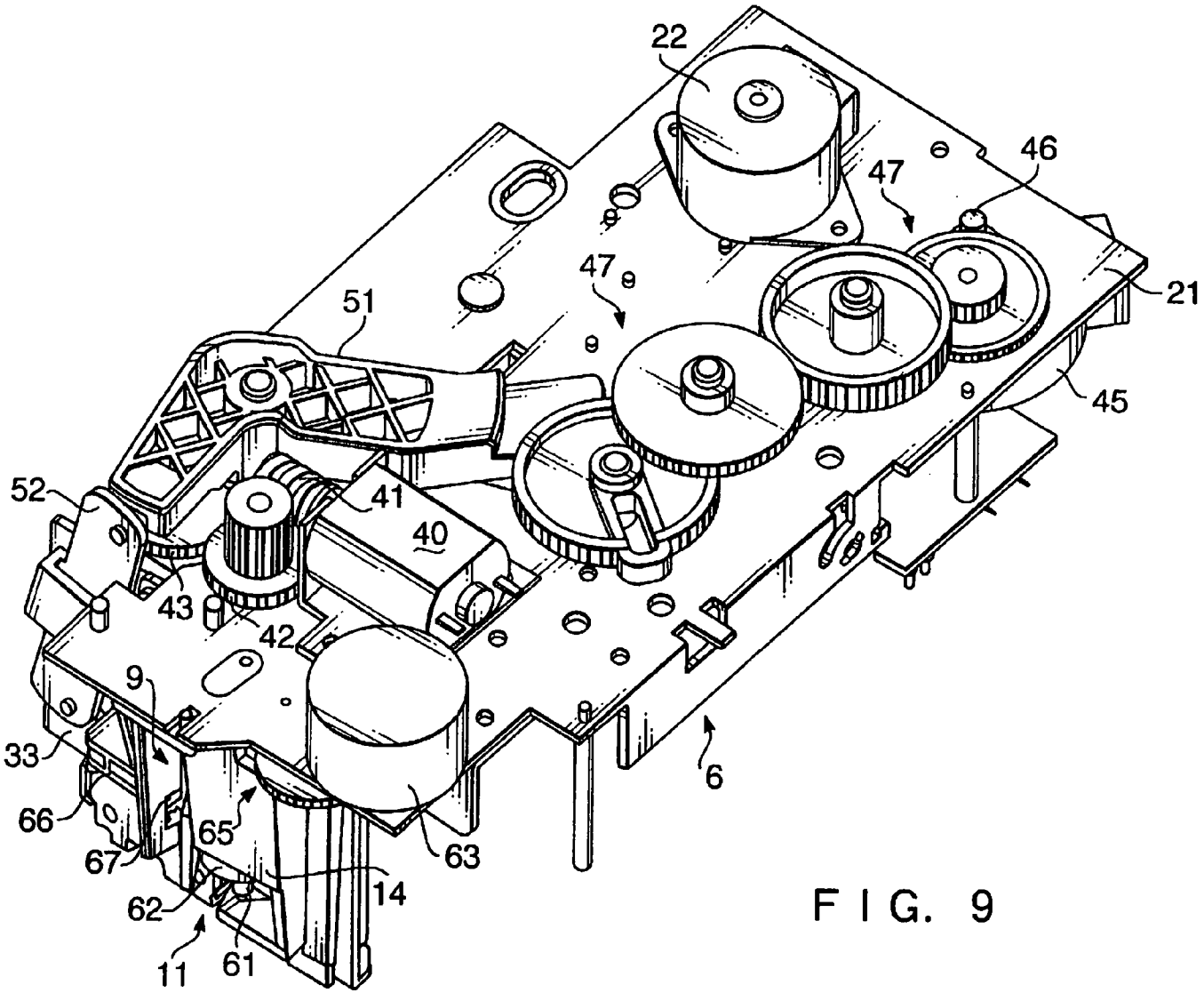
FIG. 9 is a perspective view viewing the cartridge storing part from its base.

As mentioned above, FIG. 9 is a perspective view viewing the cartridge storing part 6 (to which the cutting mechanism frame 33 has been attached) from its base. As shown in FIG. 9, a cutter blade drive motor 40 for driving the screw shaft 39 is mounted on the under surface of the frame 21 of the cartridge storing part 6. The motor shaft of the cutter blade drive motor 40 is linked with the screw shaft 39 via a worm gear 41 and reduction gears 42 and 43.

In this composition, by driving the cutter blade drive motor 40 normally and reversely, the cutter carriage 44 can be driven to and fro in the direction of the arrow A (see FIG. 8), letting the cutter blade 35 run across the label tape 100 and cut the label tape 100.

Incidentally, as shown in FIG. 8, etc., the cutter carriage 44 is integrally provided with a position indication rib 49 protruding therefrom, while rib sensors 50 and 50 are placed at both ends in the moving direction of the cutter carriage 44 (at lateral positions in the width direction of the label tape 100 avoiding interference of the cutter blade 35 with the label tape 100). Therefore, the cutter carriage 44 existing at (which has moved to) an end of its moving range can be detected by the rib sensor 50 by detecting the position indication rib 49. The detection is used for drive control of the cutter blade drive motor 40.

The cutting mechanism frame 33 is further provided with the retainer member 36 formed in a "U" shape to surround the guide shaft 38, the screw shaft 39 and the cutter carriage 44.

The retainer member 36 has two flat end faces facing the label tape 100 (facing the receiving member 37 which will be explained later). The two end faces form two retaining surfaces 36*a* and 36*b*. Each retaining surface 36*a*, 36*b* is formed in a long and narrow shape to extend in the width direction of the label tape 100 (the direction A in FIG. 8), therefore, each retaining surface 36*a*, 36*b* has a lengthwise direction parallel to the width direction of the label tape 100.

The retainer member 36 is attached to the cutting mechanism frame 33 via a proper slide guide mechanism. Therefore, the position of the retainer member 36 can be changed in the thickness direction of the label tape 100 (indicated by an arrow B in FIG. 8).

A configuration for changing the position of the retainer member 36 is shown in FIG. 9. As shown in FIG. 9, a retainer member drive motor 45 is mounted on the top surface of the frame 21. The motor shaft of the retainer member drive motor 45 projects into the base side of the frame 21 and a gear 46 is attached to the projecting part. The gear 46 is linked to an end of a first arm 51 (which is in an "L" shape and supported on the under surface of the frame 21) via a reduction gear train 47. The other end of the first arm 51 is linked to an end of a second arm 52 (in a linear shape) which is supported on a lateral part of the cutting mechanism frame 33 at its central part. The other end of the second arm 52 is linked with the retainer member 36.

In this configuration, by driving the retainer member drive motor 45 normally and reversely, the retainer member 36 can be moved to and fro in the direction of the arrow B (see FIG. 8).

Meanwhile, on the other side of the traveling path of the label tape 100 (opposite to the retainer member 36), the receiving member 37 is placed as shown in FIG. 8, etc. Projections 53 formed at the top and bottom ends of the receiving member 37 are slidably engaged with guide grooves 54 properly formed in the cutting mechanism frame 33. Consequently, the receiving member 37 is supported on the cutting mechanism frame 33 to be movable in the lengthwise direction of the guide grooves 54 (the direction indicated by the arrow B in FIG. 8, which is the thickness direction of the label tape 100).

The receiving member 37 is provided with two flat receiving surfaces 37*a* and 37*b* facing the aforementioned two end faces of the retainer member 36 (two retaining surfaces 36*a* and 36*b*) respectively. Between the receiving surfaces 37*a* and 37*b*, a groove (hollow part) 37*c* is formed.

The receiving surfaces 37*a* and 37*b* and the groove 37*c* are formed in the width direction of the label tape (the direction A in FIG. 8) to have lengthwise directions parallel to the direction A.

Between the receiving member 37 and the cutting mechanism frame 33, bias springs 48 are provided. The bias springs 48 constantly apply biasing force to the receiving member 37 in a direction letting the receiving member 37 approach the retainer member 36.

With the above configuration, the label tape 100 can be cut by the following procedure. In a step before cutting the label tape 100 with the cutter blade 35, the retainer member 36 is moved toward the receiving member 37 by driving and revolving the retainer member drive motor 45, by which the label tape 100 is sandwiched between the retaining surfaces 36*a*, 36*b* and the receiving surfaces 37*a*, 37*b*. Since the receiving member 37 is pushed toward the retainer member 36 by the biasing force of the bias springs 48, the label tape 100 is fixed firmly by the receiving member 37 and the retainer member 36. In this state, by letting the cutter blade 35 run in the direction A shown in FIG. 8, the label tape 100 is cut.

[Tape Ejecting Mechanism]

Next, the composition of the tape ejecting mechanism 11 will be described referring mainly to FIG. 4.

As shown in FIG. 4, the tape ejecting mechanism 11 is formed on the frame 21 of the cartridge storing part 6. The tape ejecting mechanism 11 includes a tape guide 14 and a roller spindle 61. The roller spindle 61 is rotatably supported by the tape guide 14 at a position just on the downstream side of the tape cutting mechanism 8 and on one side of the traveling path of the label tape 100. An ejection roller 62 is fixed to the roller spindle 61. The periphery of the ejection roller 62 makes contact with the label tape 100.

On the under surface of the frame 21, an ejection unit drive motor 63 is mounted as shown in FIG. 4. The motor shaft 64 of the ejection unit drive motor 63 projects into the top side of the frame 21. The motor shaft 64 is linked to the roller spindle 61 via a reduction gear train 65.

On the other side of the traveling path of the label tape 100 (opposite to the ejection roller 62), a retainer arm 66 is supported on the frame 21. The retainer arm 66 formed in an "L" shape points its tip toward the ejection roller 62. A wheel 67 is rotatably supported at the tip of the retainer arm 66.

The retainer arm 66 is linked with the second arm 52 which moves the retainer member 36 in the tape cutting mechanism 8. Therefore, when the retainer member drive motor 45 is driven and the label tape 100 is sandwiched and held between the retainer member 36 and the receiving member 37, the retainer arm 66 also moves toward the ejection roller 62, by which the label tape 100 is sandwiched and held between the ejection roller 62 and the wheel 67 at the tip of the retainer arm 66.

In the above composition, by driving the ejection unit drive motor 63 after the cutting (the aforementioned full cut) of the label tape 100 is executed by the cutter blade 35 of the tape cutting mechanism 8, the ejection roller 62 rotates in the clockwise direction in FIG. 4 with the label tape 100 sandwiched between the outer surface of the ejection roller 62 and the wheel 67. Consequently, the label tape 100 after being cut off is fed by the ejection roller 62 and ejected from the outlet 9 to the lower left of FIG. 4.

As above, the ejection unit drive motor 63 for driving the ejection roller 62 is provided independently of the cartridge drive motor 22 for driving the tape feeding mechanism 7. Therefore, the ejection roller 62 can be driven and stopped independently of the motion of the tape feeding mechanism 7, by which revolving speed, revolving time, revolution start/stop timing, etc. of the ejection roller 62 can be controlled freely (details of the drive control of the ejection roller 62 will be described later).

Further, the ejection unit drive motor 63 is used for driving the ejection roller 62 only (exclusively for the driving of the ejection roller 62), therefore, the ejection roller 62 can be controlled independently of other mechanisms.

It is possible to use the ejection unit drive motor 63 also for driving other mechanisms like the tape feeding mechanism 7. In such cases, the ejection roller 62 can be driven and stopped by switching the connection/disconnection of power transmission from the ejection unit drive motor 63 to the ejection roller 62 by use of a proper power connection/disconnection mechanism like a cam, clutch, planetary gear train, etc.

Next, the cutting by the cutter blade 35 and the ejection by the ejection roller 62 will be described referring to FIGS. 10 through 12.

Figure 10:
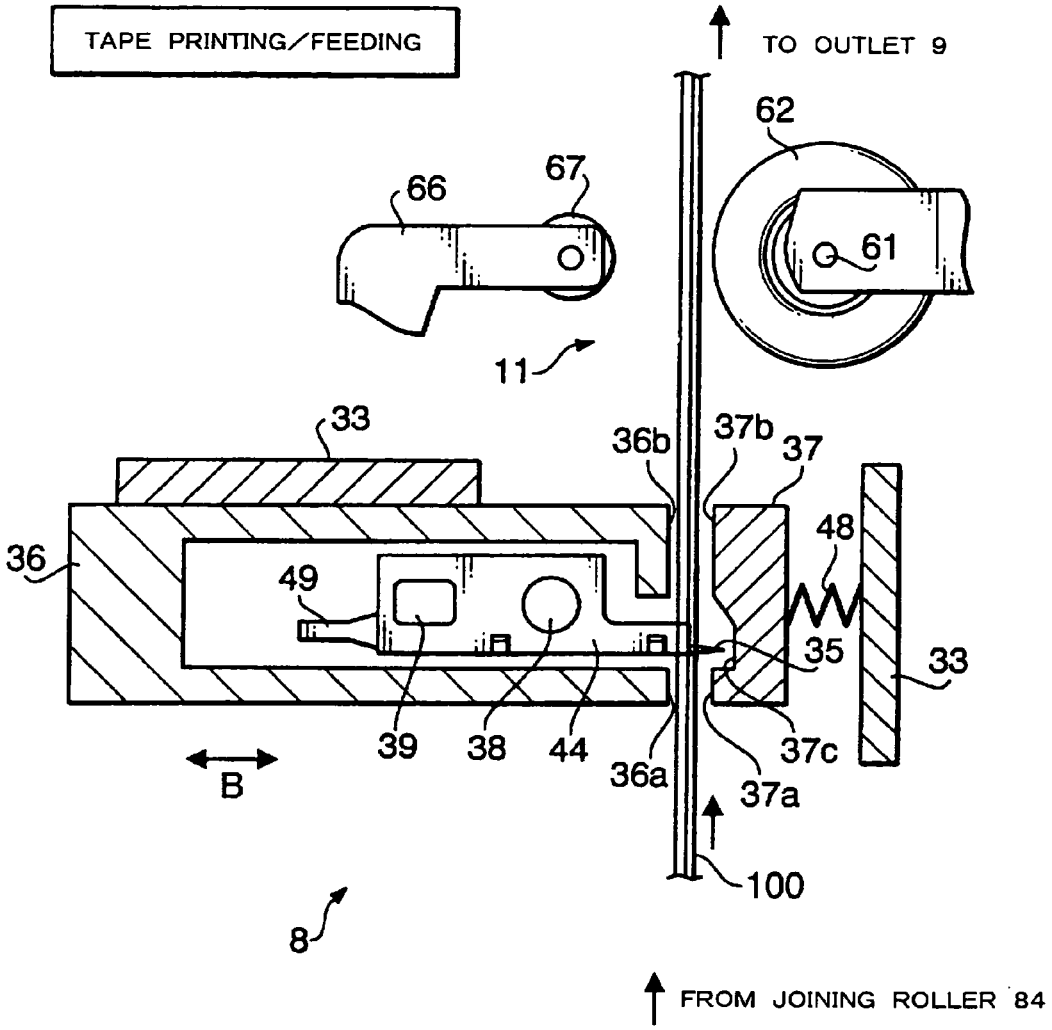
FIG. 10 is a cross-sectional view of the tape cutting mechanism showing the behavior of label tape being fed and passing between a retainer member and a receiving member in the tape cutting mechanism.
Figure 11:
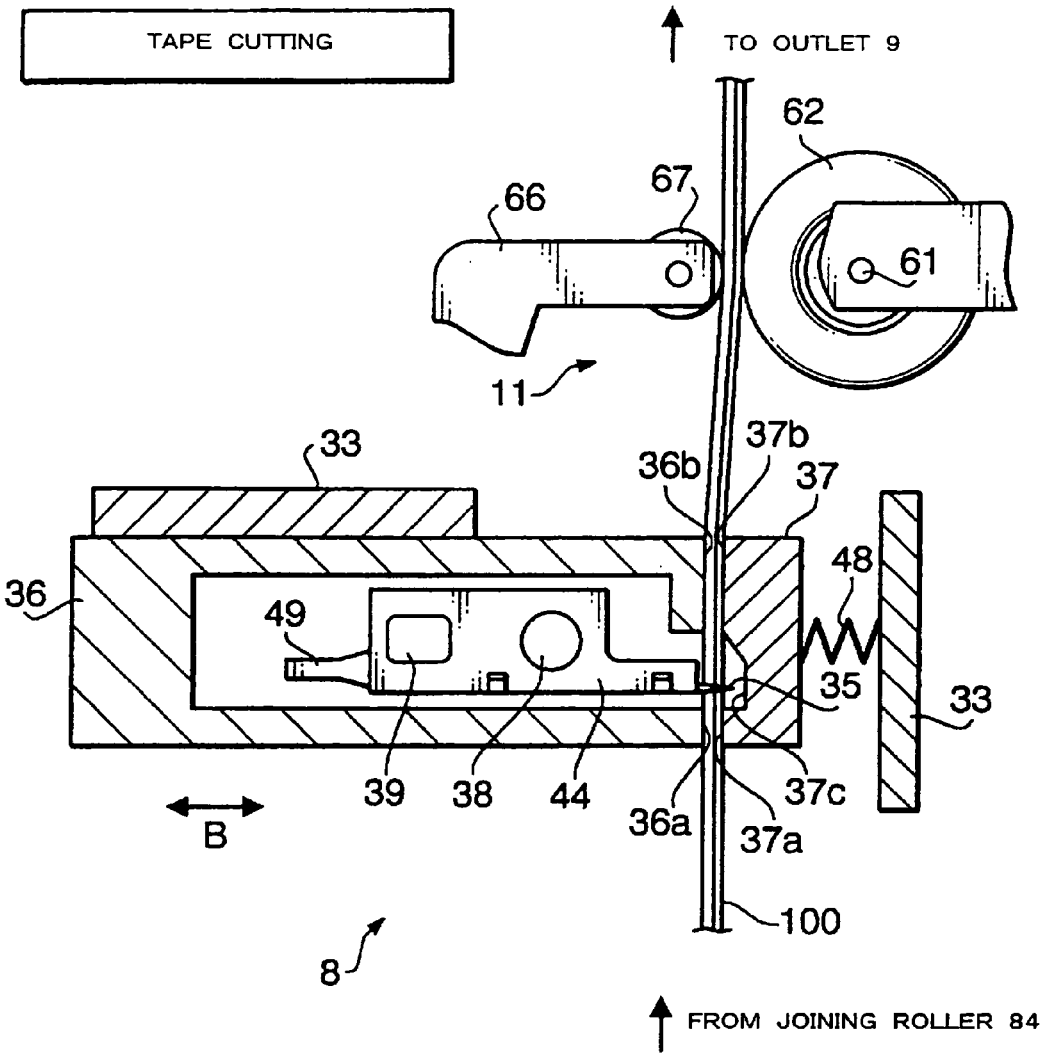
FIG. 11 is a cross-sectional view of the tape cutting mechanism showing a state in which the retainer member has moved and the label tape is sandwiched and held between the retainer member and the receiving member.
Figure 12:
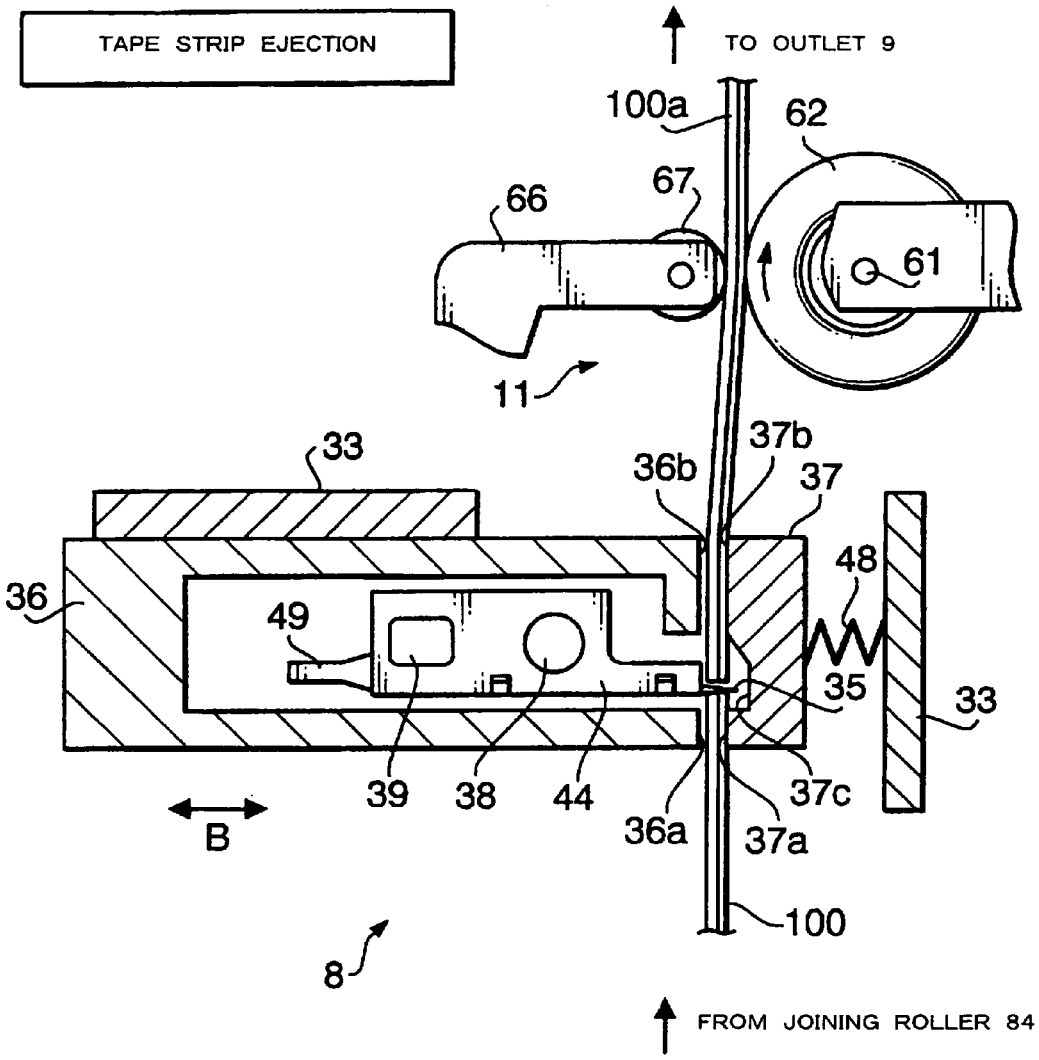
FIG. 12 is a cross-sectional view of the tape cutting mechanism showing a state in which the retainer member withdraws a little after the cutting of the label tape and the label tape is ejected by an ejection roller.

Incidentally, FIGS. 10 through 12 correspond to cross-sectional views taken along the line X-X shown in FIG. 8.

FIG. 10 shows the behavior of the label tape being fed and passing between the retainer member 36 and the receiving member 37 in the tape cutting mechanism 8. In other words, FIG. 10 shows a state in which the label tape 100 being printed on by the thermal head 32 is fed by the joining roller 84.

FIG. 11 shows a state in which the retainer member 36 has moved and the label tape is sandwiched and held between the retainer member 36 and the receiving member 37.

FIG. 12 shows a state in which the retainer member withdraws a little after the cutting of the label tape and the label tape is ejected by the ejection roller.

When the printing by the thermal head 32 is executed, the retainer member 36 is moved by the retainer member drive motor 45 to withdraw enough in a direction separating from the traveling path of the label tape 100 (direction separating from the receiving member 37). Although the receiving member 37 is biased toward the retainer member 36 by the bias springs 48, when the projections 53 (FIG. 8) of the receiving member 37 make contact with edges at the ends of the guide grooves 54, the receiving member 37 can not move further toward the retainer member 36. Therefore, the retaining surfaces 36*a* and 36*b* of the retainer member 36 and the receiving surfaces 37*a* and 37*b* of the receiving member 37 separate from each other and a gap is formed between the members 36 and 37 as shown in FIG. 10. The label tape 100 fed by the joining roller 84 while being printed on by the thermal head 32 passes through the gap.

Incidentally, the traveling of the label tape 100 is not disturbed by the cutter carriage 44 or the cutter blade 35 since the cutter carriage 44 has withdrawn to a position by the tape traveling path.

In the state of FIG. 10, the retainer arm 66 of the tape ejecting mechanism 11 is also at a withdrawn position and thereby the wheel 67 stays apart from the ejection roller 62. Therefore, the traveling of the label tape 100 is not disturbed by the retainer arm 66 or the wheel 67. In the tape printing/feeding state of FIG. 10, by properly revolving the ejection roller 62 clockwise in FIG. 10, the traveling of the label tape 100 is assisted by the ejection roller 62 and thereby the label tape 100 can be fed smoothly.

After the printing by the thermal head 32 is finished, the cartridge drive motor 22 is stopped so as to stop the feeding by the joining roller 84 while the retainer member drive motor 45 is driven so as to move the retainer member 36 in a direction approaching the receiving member 37. Consequently, the label tape 100 is sandwiched and firmly fixed between the retainer member 36 and the receiving member 37 as shown in FIG. 11. In this state, the retainer arm 66 also moves toward the ejection roller 62 and thereby the label tape 100 is sandwiched and held between the wheel 67 and the ejection roller 62.

In this state, by driving the cutter blade drive motor 40, the cutter blade 35 moves in the direction A shown in FIG. 8 and cuts the label tape 100. Consequently, a label tape strip 100*a* (FIG. 12), cut away from the label tape 100, is formed on the downstream side of the cutting position. The label tape strip 100*a* is sandwiched and held between the wheel 67 and the ejection roller 62 while also being sandwiched and held between the retainer member 36 and the receiving member 37.

Subsequently, the retainer member drive motor 45 is driven and thereby the retainer member 36 is withdrawn a bit, by which the holding by the retainer member 36 and the receiving member 37 is released while the holding by the wheel 67 and the ejection roller 62 is maintained as shown in FIG. 12.

In this state, by driving the ejection unit drive motor 63, the ejection roller 62 revolves clockwise in FIG. 12 and thereby the label tape strip 100*a* is ejected toward the outlet 9.

[Control System]

Next, a control system employed in this embodiment will be described.

Figure 13:
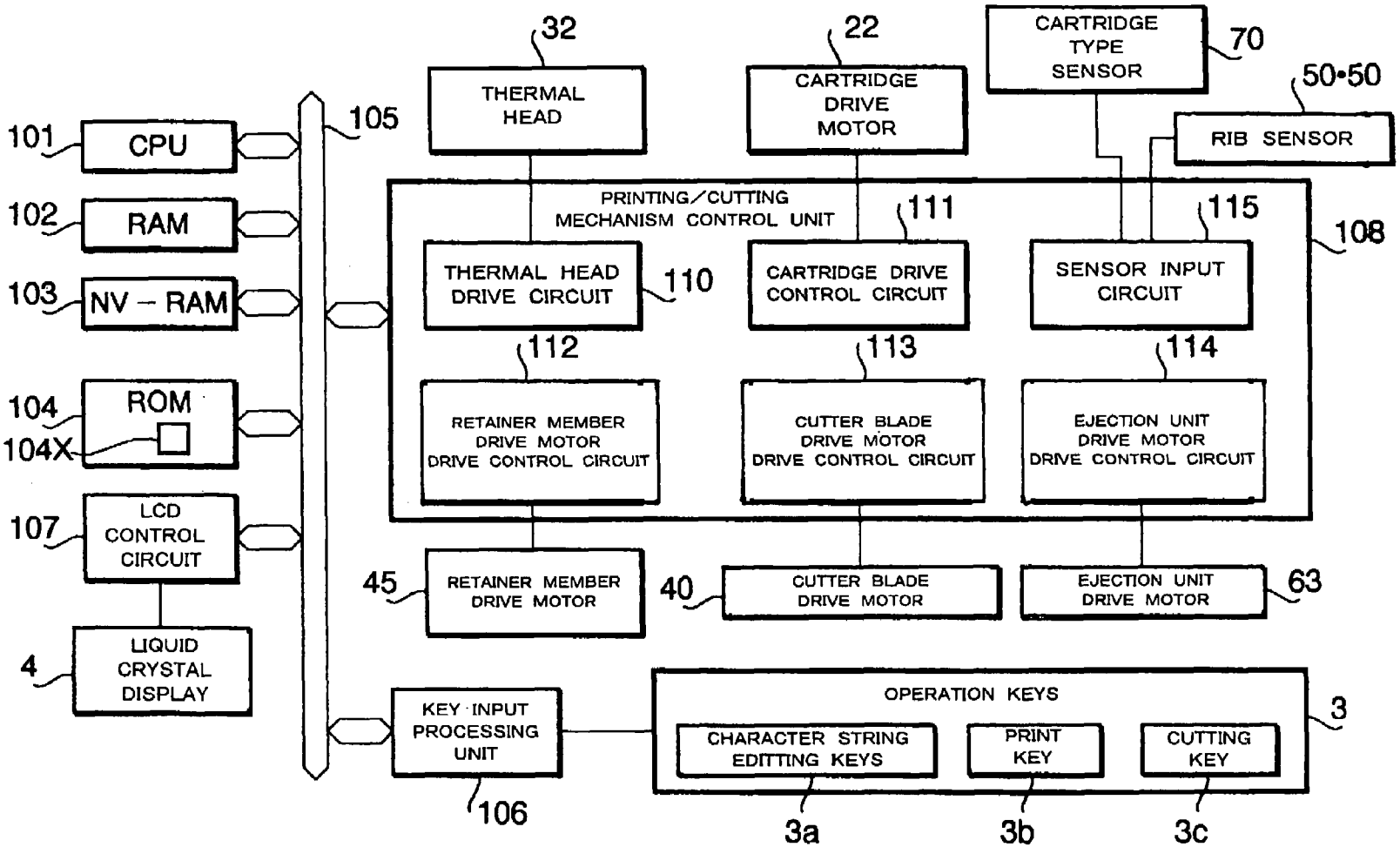
FIG. 13 is a block diagram showing a control system of the tape printing device.
Figure 14:
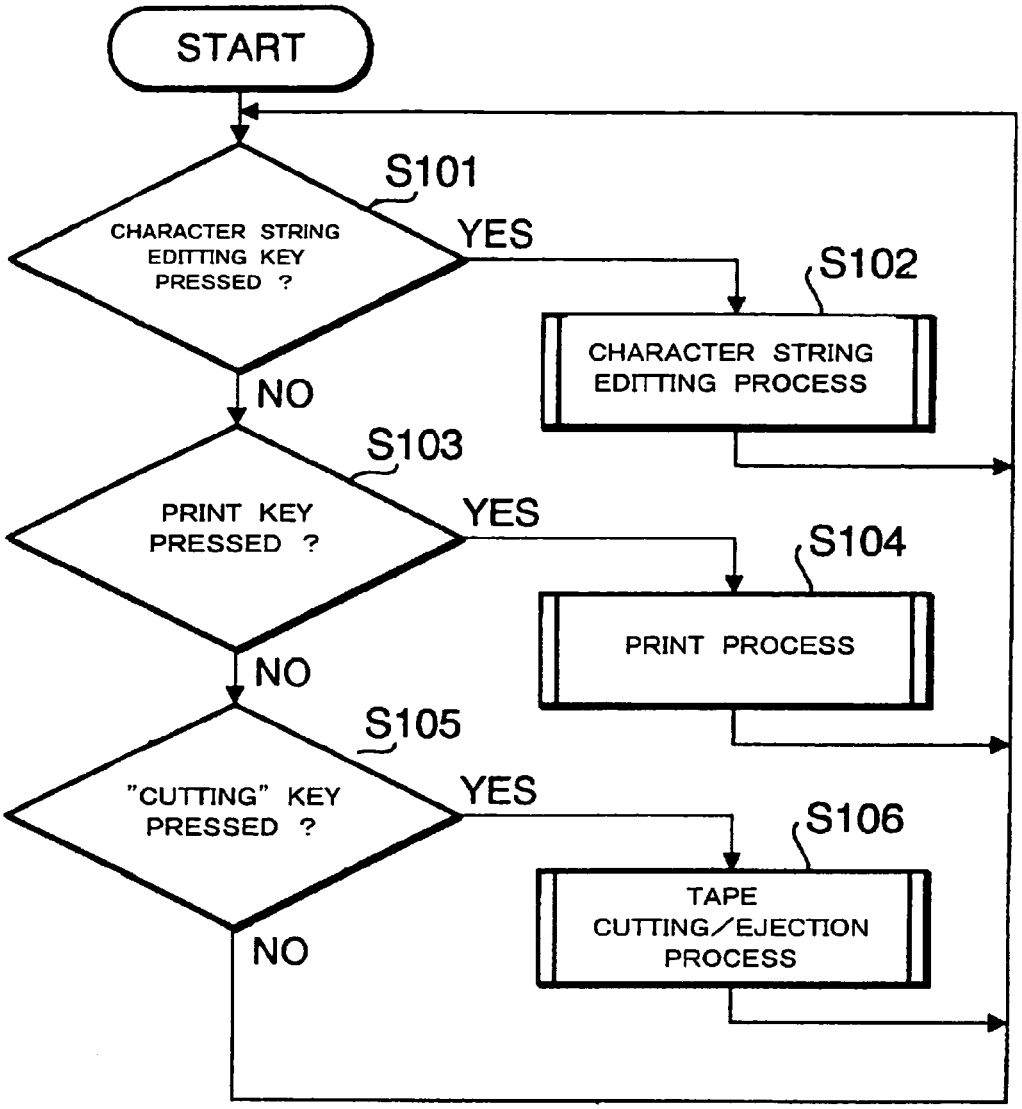
FIG. 14 is a main flow chart showing a control flow of the tape printing device.
Figure 15:
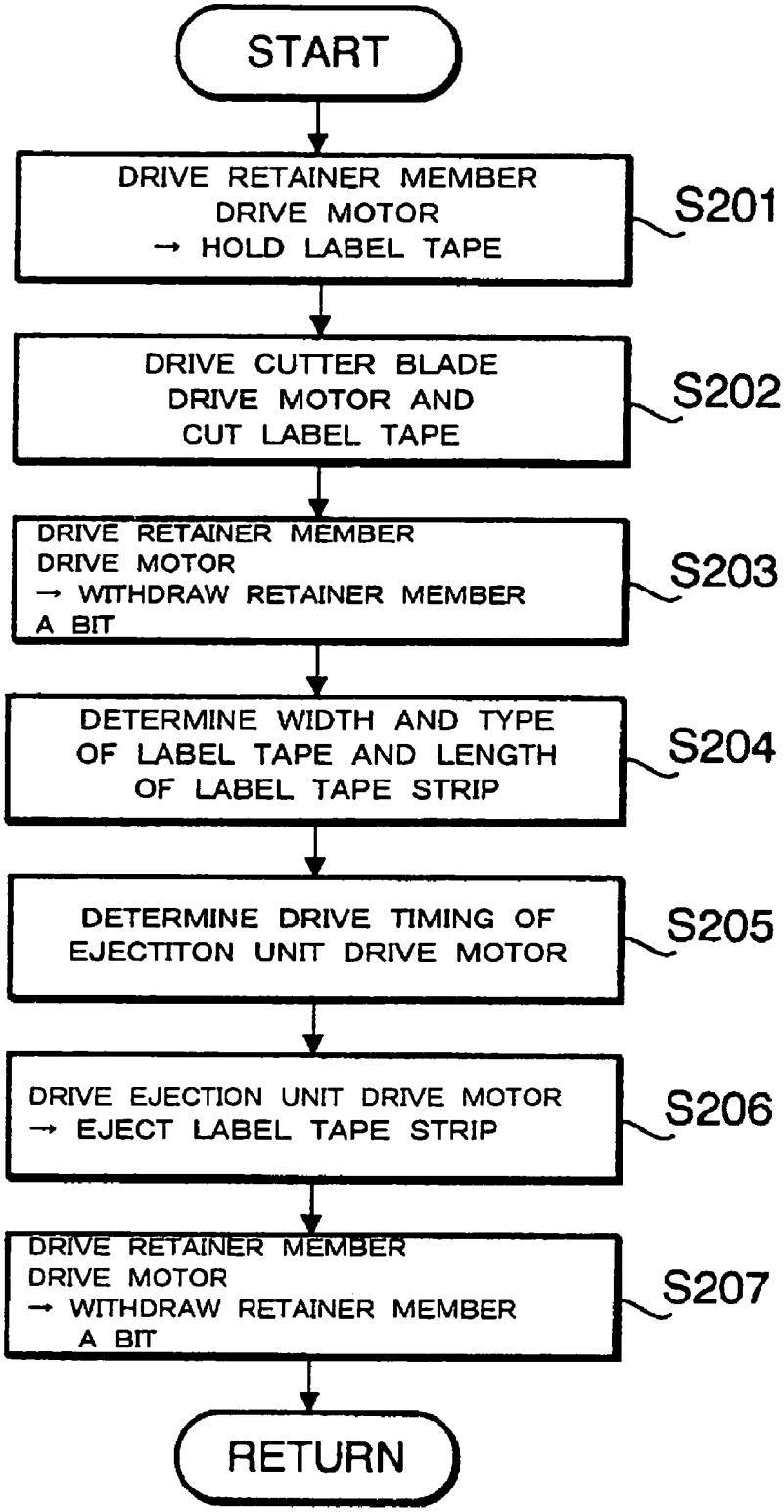
FIG. 15 is a flow chart showing a subroutine of a tape cutting/ejection process.

FIG. 13 is a block diagram showing the control system of the tape printing device 1 of this embodiment. FIG. 14 is a main flow chart showing a control flow of the tape printing device. FIG. 15 is a flow chart showing a subroutine of a tape cutting/ejection process. FIG. 16 is a table showing a table which is stored in a ROM for specifying driving time of the ejection unit drive motor.

As shown in FIG. 13, in the tape printing device 1, a central processing unit (CPU) 101 for controlling the whole tape printing device 1, a RAM 102 for storing temporary data, a nonvolatile memory (NV-RAM) 103 for storing semi-fixed data, and a ROM 104 for storing fixed data such as a control program are connected together by a bus 105. To the bus 105, a key input processing unit 106 for receiving and processing key inputs from the operation keys 3, an LCD control unit 107 for controlling display on the liquid crystal display 4, and a printing/cutting mechanism control unit 108 for controlling the thermal head 32, various motors, etc. are also connected.

The printing/cutting mechanism control unit 108 includes a thermal head control circuit 110 for controlling electric currents to be supplied to the heating elements of the thermal head 32 as a printing unit. The printing/cutting mechanism control unit 108 further includes various control circuits (111-114) for controlling the driving/stopping of the cartridge drive motor 22, the retainer member drive motor 45, the cutter blade drive motor 40, the ejection unit drive motor 63, etc.

The printing/cutting mechanism control unit 108 further includes a sensor input circuit 115 for receiving and processing electric signals from the cartridge type sensor 70 and the rib sensors 50, 50.

FIG. 14 shows a main flow indicating the operation of the above control system. In the loop of the main flow, the CPU 101 first judges whether or not any one of character string editing keys 3*a* has been pressed (step S101). When a key has been pressed (S101: YES), the CPU 101 executes a subroutine of a character string editing process (S102). In the subroutine process, a character is added to or deleted from the character string stored in the RAM 102 depending on the pressed key and thereby memory contents of the RAM 102 and the display on the liquid crystal display 4 are updated.

Subsequently, the CPU 101 judges whether the print key 3*b* has been pressed or not. If the print key 3*b* has been pressed (S103: YES), the CPU 101 executes a subroutine of a print process (S104). In the subroutine of the print process, the contents of the RAM 102 stored in the character string editing process (input character string data) are read out and image data is developed and temporarily stored in the RAM 102 according to the input character string data, while driving the cartridge drive motor 22. According to the image data, electric current is selectively supplied to heating elements of the thermal head 32 with prescribed timing, by which a corresponding image is formed on the laminate tape 91. The driving of the cartridge drive motor 22 is continued further, letting the joining roller 84 join the laminate tape 91 and the double-layer tape 93 together, by which the label tape 100 is formed. At the point when the image formation part of the label tape 100 has moved to the downstream side of the cutter blade 35, the driving of the cartridge drive motor 22 is stopped at last.

In step S105, the CPU 101 judges whether a "cutting" key 3*c* has been pressed or not. If the "cutting" key 3*b* has been pressed (S105: YES), the CPU 101 executes a subroutine of a tape cutting/ejection process (S106).

The above is the main loop. Next, the subroutine of the tape cutting/ejection process will be described below.

[Subroutine of Tape Cutting/Ejection Process]

FIG. 15 is a flow chart showing the subroutine of the tape cutting/ejection process (step S106 of FIG. 14). In this flow, the CPU 101 first moves the retainer member 36 (at the withdrawn position in FIG. 10) to the position of FIG. 11 (cutting position) by properly driving the retainer member drive motor 45, letting the retainer member 36 and the receiving member 37 sandwich and hold the label tape 100 (S201).

Since the wheel 67 also moves toward the ejection roller 62 along with the movement of the retainer member 36, the label tape 100 is also sandwiched and held between the wheel 67 and the ejection roller 62 while being sandwiched and held between the retainer member 36 and the receiving member 37.

In step S202, the CPU 101 cuts the label tape 100 and forms a label tape strip 100*a* by driving the cutter blade drive motor 40 in the state shown in FIG. 11 and letting the cutter carriage 44 run from one end to the other end. The label tape 100 cut off in the step S202 is held being sandwiched between the wheel 67 and the ejection roller 62.

In the next step S203, the CPU 101 withdraws the retainer member 36 a bit by properly driving the retainer member drive motor 45 and thereby releases the holding of the label tape 100 by the retainer member 36 and the receiving member 37 as shown in FIG. 12 (the holding of the label tape strip 100*a* by the wheel 67 and the ejection roller 62 is not released).

Subsequently, by a process from step S204, the ejection roller 62 is revolved and thereby the label tape strip 100*a* is ejected from the outlet 9. In the tape printing device 1 of this embodiment, the revolving time of the ejection roller 62 is changed in various ways depending on the type of the label tape 100.

Specifically, the time for passing an electric current through the ejection unit drive motor 63 has been preset as shown in FIG. 16 depending on the type of the label tape 100 (laminate type or non-laminate type), the width of the label tape (6 mm, 9 mm, 12 mm, 18 mm, 24 mm, 36 mm) and the length of the label tape strip 100*a*.

For example, when 6-mm-wide label tape of a laminate thermal transfer type is used and the length of the label tape strip 100*a* is 150 mm, the electric current is passed through the ejection unit drive motor 63 for 30 ms. Even if the label tape strip is of the same type and same length, the ejection unit drive motor 63 is energized only for 20 ms when the label tape width is 24 mm.

When the label tape width is 6 mm, the time for passing the electric current through the ejection unit drive motor 63 increases 1.5-fold (the revolving time of the ejection roller 62 also increases 1.5-fold) compared to a corresponding case where the label tape width is 24 mm, by which the ejection roller 62 revolves more powerfully and the label tape strip is fed toward the outlet 9 at higher speed.

Such a light label tape strip (6 mm wide) can have little inertial force and thus its ejection speed is easily diminished by air resistance during the ejection through the outlet 9. The above time control is based on consideration aiming to compensate for the fast decay of ejection speed by increasing the initial ejection speed.

The contents of the table of FIG. 16 are prestored in a proper storage area 104X of the ROM 104 (or the NV-RAM 103) in a table format.

In step S204, the CPU 101 determines the type of the tape cartridge 10 (the width and type of the label tape 100) based on the detection by the cartridge type sensor 70.

The CPU 101 also determines the length of the label tape strip 100*a* by calculation. The length of the label tape strip 100*a* is figured out based on the character string length of the input character string data and set values regarding print margins, etc., that is, based on information on the size of the image formed on the label tape strip 100*a*. It is also possible to specially provide the tape printing device 1 with a sensor for detecting the feeding length of the label tape 100 directly and mechanically.

In step S205, the CPU 101 determines the driving time of the ejection unit drive motor 63 (time for passing the electric current through the ejection unit drive motor 63) by applying these parameters (the width and type of the label tape 100 and the feeding length of the label tape 100 (the length of the label tape strip 100*a*)) to the table of FIG. 16. Thereafter, the ejection unit drive motor 63 is driven for the determined driving time (S206).

Consequently, the time for driving the ejection roller 62 can be adjusted finely depending on the width and type of the label tape 100 and the length of the label tape strip 100*a* (the feeding length of the label tape 100). For example, when a label tape strip 6 mm wide is ejected, the ejection roller 62 is driven for a longer time compared to a case where a label tape strip 24 mm wide is ejected. Therefore, even when a lot of various label tape strips 100*a* are created and ejected, the scattering of ejected label tape strips 100*a* over a wide area can be avoided.

After the ejection of the label tape strip 100*a*, the CPU 101 drives the retainer member drive motor 45 and thereby moves the retainer member 36 to the original withdrawn position of FIG. 10 (S207). Since the wheel 67 also separates from the ejection roller 62 along with the movement of the retainer member 36 to the withdrawn position, the printing/feeding of the label tape 100 becomes possible again. When the step S207 is finished, the subroutine of the tape cutting/ejection process is ended.

As described above, by the present invention, ejection distance of a tape-like object can be changed and adjusted depending on at least one selected from the shape, the material and the type (laminate structure, etc.) of the tape-like object and the feeding length at the point when the tape-like object is cut by the cutting mechanism.

While the above description has been given of an embodiment of the present invention, the technical scope of the present invention is not to be restricted by the above particular illustrative embodiment. Various modifications, design changes, etc. can be made to the embodiment without departing from the scope and spirit of the present invention.

For example, while the revolving time of the ejection roller 62 is controlled in the above embodiment, it is also possible to control the revolving speed, revolving timing, etc. of the ejection roller 62 in addition to (or instead of) the revolving time control.

Even when the length of the label tape strip 100 (the feeding length of the label tape 100) is the same, the revolving control of the ejection roller 62 can be changed depending on the contents of printing. By such control, ejection positions of labels (positions as the result of ejection) can be grouped into several groups depending on the contents of printing, by which the handling of labels after the ejection can be facilitated further.

When sequential printing in the order of sequence numbers is carried out, the revolving control of the ejection roller 62 may be changed depending on the printing order (numerical order). In this case, the workload of the user for arranging the ejected labels in the printing order can be lightened.

It is to be appreciated that the above description of the embodiment has been given by way of illustration and the scope of the present invention is not to be restricted by the particular illustrative embodiment but to be understood based on the description of the appended claims.

What is claimed is:

1. A label tape printing device for printing on a tape-like object, comprising:

a tape-like object feeding device for feeding the tape-like object, the tape-like object feeding device including:

a feeding mechanism that feeds the tape-like object toward an outlet;

a cutting mechanism that cuts the tape-like object fed by the feeding mechanism;

an ejection roller placed on an outlet side of the cutting mechanism for ejecting the tape-like object cut off by the cutting mechanism through the outlet by revolving while making contact with the tape-like object wherein the ejection roller is operated independently of any cutting mechanisms;

a sensor that determines at least one of a type of the tape-like object and a thickness of the tape-like object; and a controller which controls at least one of revolving speed, revolving time and revolving timing of the ejection roller in ejecting the tape-like object depending on the determination by the sensor.

2. The label tape printing device according to claim 1, wherein the tape-like object feeding device further includes a driver for driving the feeding mechanism and a driver for driving the ejection roller are provided separately and independently.

3. The label tape printing device according to claim 1, further comprising:

an image formation unit placed on an upstream side of the cutting mechanism for forming an image on the label tape.

4. The label type printing device according to claim 1, wherein the sensor further determines a feeding length of the tape-like object by the feeding mechanism at the point when the tape-like object is cut off by the cutting mechanism.

5. A tape-like object feeding device for feeding a tape-like object, comprising:

a feeding mechanism that feeds the tape-like object toward an outlet;

a cutting mechanism that cuts the tape-like object fed by the feeding mechanism;

an ejection roller placed on a downstream side of the cutting mechanism in a feeding path of the tape-like object for ejecting the tape-like object cut off by the cutting mechanism by revolving while making contact with the tape-like object wherein the ejection roller is operated independently of any cutting mechanisms;

a sensor that determines at least one of a type of the tape-like object and a thickness of the tape-like object; and a controller which executes driving control of the ejection roller in ejecting the tape-like object which has been cut off, depending on the determination by the sensor.

6. The tape-like object feeding device according to claim 5, wherein the type of the tape-like object includes at least one selected from shape, material and laminate structure of the tape-like object.

7. The tape-like object feeding device according to claim 5, wherein the controller changes control regarding at least one of revolving time, revolving speed and revolving timing of the ejection roller depending on at least one selected from the type of the tape-like object determined by the sensor and a feeding length of the tape-like object by the feeding mechanism at the point when the tape-like object is cut off by the cutting mechanism.

8. The tape-like object feeding device according to claim 5, wherein the sensor determines the type of the tape-like object.

9. The tape-like object feeding device according to claim 5, wherein the controller includes:

a first driver that drives the ejection roller; and a second driver that drives the feeding mechanism, and wherein the ejection roller and the feeding mechanism are controlled independently by driving the first and second drivers separately.

10. The tape-like object feeding device according to claim 5, wherein the controller includes:

a common driving system which is used for driving the ejection roller and the feeding mechanism; and a power connection/disconnection mechanism for switching connection/disconnection of power transmission from the common driving system to the ejection roller or the feeding mechanism, and wherein the ejection roller and the feeding mechanism are controlled independently by controlling the power connection/disconnection mechanism.

11. The tape-like object feeding device according to claim 5, wherein the controller includes a calculating system which calculates a feeding length of the tape-like object by the feeding mechanism at the point when the tape-like object is cut off by the cutting mechanism based on information on contents of printing on the tape-like object.

12. The tape-like object feeding device according to claim 5, wherein the sensor further determines a feeding length of the tape-like object by the feeding mechanism at the point when the tape-like object is cut off by the cutting mechanism.

13. The tape-like object feeding device according to claim 5, wherein the tape-like object is a label tape.

14. The feeding device according to claim 5, wherein the controller controls at least the revolving time of the ejection roller in ejecting the tape-like object depending on at least one selected from a type of the tape-like object, a thickness of the tape-like object, and a width of the tape like object.

15. A printing device comprising:

a feeding mechanism that feeds a tape-like object toward an outlet;

a cutting mechanism that cuts the tape-like object fed by the feeding mechanism;

an ejection roller placed on a downstream side of the cutting mechanism in a feeding path of the tape-like object for ejecting the tape-like object cut off by the cutting mechanism by revolving while making contact with the tape-like object wherein the ejection roller is operated independently of any cutting mechanisms;

an image formation unit placed on an upstream side of the cutting mechanism in the feeding path for forming an image on the tape-like object;

a sensor that determines at least one of a type of the tape-like object and a thickness of the tape-like object; and a controller which executes driving control of the ejection roller in ejecting the tape-like object which has been cut off, depending on the determination by the sensor.

16. The printing device according to claim 15, wherein the controller executes the driving control of the ejection roller in the ejection of the tape-like object which has been cut off, further considering at least one selected from information on size of the image generated by the image formation unit and order of image formation in sequential formation of a plurality of images.

17. The printing device according to claim 15, wherein the sensor further determines a feeding length of a tape-like object by the feeding mechanism at the point when the tape-like object is cut off by the cutting mechanism.

* * * * *